US011278781B2

(12) United States Patent
Wang

(10) Patent No.: US 11,278,781 B2
(45) Date of Patent: Mar. 22, 2022

(54) FOLDABLE BASKETBALL STAND

(71) Applicant: LIVEN SPORTS MFG. (Xiamen) Co., Ltd., Xiamen (CN)

(72) Inventor: Jen-Hung Wang, Taipei (TW)

(73) Assignee: LIVEN SPORTS MFG. (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 16/892,771

(22) Filed: Jun. 4, 2020

(65) Prior Publication Data

US 2021/0245024 A1 Aug. 12, 2021

(30) Foreign Application Priority Data

Feb. 7, 2020 (CN) ..... 202020156883.6

(51) Int. Cl.
*A63B 63/08* (2006.01)
*A63B 63/00* (2006.01)

(52) U.S. Cl.
CPC ..... *A63B 63/083* (2013.01); *A63B 2063/001* (2013.01); *A63B 2210/50* (2013.01)

(58) Field of Classification Search
CPC ..... A63B 69/0071; A63B 63/083; A63B 2063/001; A63B 2210/50; A63B 63/00; A63B 71/022; A63B 2225/09
See application file for complete search history.

(56) References Cited

U.S. PATENT DOCUMENTS 2,144,148 A * 1/1939 Gross ..... A63B 63/083 473/481
2,747,875 A * 5/1956 Martin ..... A63B 67/06 273/397
3,501,140 A * 3/1970 Eichorn ..... A63B 21/154 482/130
D222,978 S * 2/1972 Gustavo ..... D21/705
D284,599 S * 7/1986 Cochran ..... D21/305
4,805,917 A * 2/1989 Cochran ..... A63B 47/025 273/397
5,133,546 A * 7/1992 Matherne ..... A63B 24/0021 273/375
5,246,225 A * 9/1993 Matherne ..... A63B 24/0021 273/375
5,312,099 A * 5/1994 Oliver, Sr. ..... A63B 63/083 473/433
5,692,976 A * 12/1997 Yu ..... A63B 63/083 273/397

(Continued)

*Primary Examiner* — Melba Bumgarner
*Assistant Examiner* — Amir A Klayman
(74) *Attorney, Agent, or Firm* — Muncy, Geissler, Olds & Lowe, P.C.

(57) ABSTRACT

A foldable basketball stand has at least one first hoop on a rear end surface of a backboard on an upper half portion of a front frame. A middle portion of first left/right rod of the front frame has two first left/right joints respectively. One end and the other end of left top/bottom rod of a left frame are connected to a left-rear rod/the first left rod respectively. One end and the other end of right top/bottom rod of a right frame are connected to a right-rear rod/the first right rod respectively. A middle portion of left/right rear rod has first/second rear joints respectively. An upper half portion of a rear frame has a stop portion. Left/right sides of the rear frame are connected to left/right rear rods through left/right connecting rods respectively.

7 Claims, 7 Drawing Sheets

(56) References Cited

U.S. PATENT DOCUMENTS 5,803,841 A * 9/1998 Daskoski ..... A63B 69/0002 473/454
6,093,120 A * 7/2000 Luke, Jr. ..... A63B 69/0002 473/435
6,652,395 B2 * 11/2003 Goldwitz ..... A63B 63/004 473/476
6,929,569 B1 * 8/2005 Wang ..... A63B 24/0021 473/433
6,979,274 B1 * 12/2005 Raber ..... A63B 63/004 473/471
7,328,902 B1 * 2/2008 White ..... A63B 63/00 273/343
7,404,562 B2 * 7/2008 Chen ..... A63B 69/0071 273/317.3
7,727,091 B2 * 6/2010 Allen ..... A63B 67/04 473/496
7,955,238 B2 * 6/2011 Dokshutsky ..... A63B 21/154 482/129
9,272,176 B1 * 3/2016 Bendror ..... A63B 21/4035
9,925,413 B1 * 3/2018 Heisserman ..... A63B 22/16
9,993,677 B2 * 6/2018 Todokoro ..... A63B 9/00
10,201,736 B2 * 2/2019 Tsai ..... A63B 67/002
10,207,142 B2 * 2/2019 Le Nguyen ..... A63B 1/00
10,220,281 B2 * 3/2019 Luo ..... A63B 69/0071
10,330,247 B2 * 6/2019 Shimodaira ..... B64G 1/222
10,603,559 B1 * 3/2020 Farley ..... A63B 69/002
10,632,357 B1 * 4/2020 Hudson ..... A63B 69/3667
D892,965 S * 8/2020 Davis ..... D22/113
2005/0192126 A1 * 9/2005 Remaklus ..... A63B 67/02 473/447
2006/0148599 A1 * 7/2006 Haddix ..... A63B 63/00 473/535
2008/0081713 A1 * 4/2008 Huang ..... A63B 69/0071 473/481
2008/0252018 A1 * 10/2008 Chung ..... A63B 24/0021 273/402
2009/0105052 A1 * 4/2009 Dalebout ..... A63B 21/06 482/133
2012/0015764 A1 * 1/2012 Tynes ..... A63B 63/008 473/439
2014/0235375 A1 * 8/2014 Crosby ..... A63B 63/083 473/481
2016/0144256 A1 * 5/2016 Lee ..... A63B 69/002 473/416
2017/0368463 A1 * 12/2017 Ritchie ..... A63G 31/007
2020/0086193 A1 * 3/2020 Lu ..... A63B 69/0071
2020/0281801 A1 * 9/2020 Karlovich ..... A61G 5/124
2021/0038964 A1 * 2/2021 Beard ..... A63B 71/023

* cited by examiner

FOLDABLE BASKETBALL STAND

FIELD OF THE INVENTION

The present invention is related to a foldable basketball stand, especially a foldable basketball stand capable of quick disassembling and assembling, storage space saving, and easy to carry.

BACKGROUND OF THE INVENTION

A conventional outdoor basketball stand usually is composed of a backboard having a hoop and a supporting stand. For a basketball stand of a shooting machine used indoors, in order to have sufficient support strength, the length of the support frame between the hoop and the shooter is divided into two stages, so that after the basketball thrown by the shooter touches the hoop or the backboard, the basketball can roll rearward and downward through an inclined net surface, allowing the shooter to shoot continuously.

SUMMARY OF THE INVENTION

However, the above basketball stand is mainly fixed and assembled by several metal tubes and flat plates. The assembly process is slow. And the overall volume after assembled has been fixed. Due to the inconvenience of folding, it is not only inconvenient to carry but also occupies huge storage space. Accordingly, the present invention has developed a new design which may avoid the above described drawbacks, may take into account economic considerations. Therefore, the present invention then has been invented.

One object of the present invention is to provide a foldable basketball stand which can solve the problems of conventional basketball stand of slow assembly and disassembly speed and huge storage space occupied. The foldable basketball stand is the combination of the supporting rods and the connecting joints, which can achieve quick assembly and disassembly, and can effectively save storage space after disassembly and facilitate the carrying.

In order to achieve the purpose of the present invention, the present invention provides a foldable basketball stand which mainly comprises a front frame, a left frame, a right frame, and a rear frame. The front frame comprises a top rod, a first left rod, a bottom rod and a first right rod. The first left rod has an upper portion, a middle portion and a lower portion. The first right rod has an upper portion, a middle portion and a lower portion. Two ends of the top rod are connected to a top end of the upper portion of the first left rod and a top end of the upper portion of the first right rod respectively. Two ends of the bottom rod are connected to a bottom end of the lower portion of the first left rod and a bottom end of the lower portion of the first right rod respectively. A first left joint and a second left joint are disposed on the first left rod between the upper portion and the middle portion of the first left rod and between the middle portion and the lower portion of the first left rod respectively. A first right joint and a second right joint are disposed on the first right rod between the upper portion and the middle portion of the first right rod and between the middle portion and the lower portion of the first right rod respectively. The first left joint and the first right joint are left-right symmetrically disposed. The second left joint and the second right joint are left-right symmetrically disposed. An upper portion of the front frame is between the upper portion of the first left rod and the upper portion of the first right rod. A lower portion of the front frame is between the lower portion of the first left rod and the lower portion of the first right rod. A middle portion of the front frame is between the middle portion of the first left rod and the middle portion of the first right rod. The upper portion of the front frame has a rear side. The middle portion of the front frame has a rear side. The lower portion of the front frame has a rear side. A first left pivoting element is disposed on a rear side of a top end of the lower portion of the first left rod. A second left pivoting element is disposed on a rear side of the bottom end of the lower portion of the first left rod. A first right pivoting element is disposed on a rear side of a top end of the lower portion of the first right rod. A second right pivoting element is disposed on a rear side of the bottom end of the lower portion of the first right rod. The backboard is disposed on the upper portion of the front frame. A rear surface of the backboard has at least one first hoop. The left frame comprises a left-top rod, a left-bottom rod, and a left-rear rod. The left-rear rod has an upper portion and a lower portion. One end of the left-top rod and one end of the left-bottom rod are connected to a top end and a bottom end of the lower portion of the left-rear rod respectively. The other end of the left-top rod and the other end of the left-bottom rod are pivoted to the first left pivoting element and the second left pivoting element respectively. The left frame has a left side and a right side. A first rear joint is disposed on the left-rear rod between the upper portion and the lower portion of the left-rear rod. The right frame comprises a right-top rod, a right-bottom rod, and a right-rear rod. The right frame has an upper portion and a lower portion. One end of the right-top rod and one end of the right-bottom rod are connected to a top end and a bottom end of the lower portion of the right-rear rod respectively. The other end of the right-top rod and the other end of the right-bottom rod are pivoted to the first right pivoting element and the second right pivoting element respectively. The right frame has a left side and a right side. A second rear joint is disposed on the right-rear rod between the upper portion and the lower portion of the right-rear rod. The rear frame comprises an upper second top rod, a second left rod and a second right rod. The rear frame has a stop portion on an upper portion of the rear frame. Two ends of the upper second top rod are connected to a top end of the second left rod and a top end of the second right rod respectively. A middle portion of the second left rod is detachably connected to a rear end of a left connecting rod. A front end of the left connecting rod is detachably connected to the lower portion of the left-rear rod between the top end and the bottom end of the lower portion of the left-rear rod. A middle portion of the second right rod is detachably connected to a rear end of a right connecting rod. A front end of the right connecting rod is detachably connected to the lower portion of the right-rear rod between the top end and the bottom end of the lower portion of the right-rear rod. The foldable basketball stand is capable of being transformed to a folded state by removing the left connecting rod and the right connecting rod; rotating the upper portion of the left-rear rod relative to the first rear joint, so that the upper portion of the left-rear rod is parallel to the left-top rod and above the left-top rod; rotating the upper portion of the right-rear rod relative to the second rear joint, so that the upper portion of the right-rear rod is parallel to the right-top rod and above the right-top rod; rotating the left frame counterclockwise relative to the first left rod and rotating the right frame clockwise relative to the first right rod, so that the left frame and the right frame are parallel to the lower portion of the front frame, and the right side of the left frame and the left side of the right frame are facing the rear side of the lower portion of the front frame; synchronously rotating the upper portion of the first left rod relative to the first left joint and rotating the upper portion of the first right rod relative to the first right joint, so that the upper portion of the front frame is perpendicular to the middle portion of the front frame; synchronously rotating the middle portion of the first left rod relative to the second left joint and rotating the middle portion of the first right rod relative to the second right joint, so that the middle portion of the front frame is perpendicular to the lower portion of the front frame, the rear side of the middle portion of the front frame is facing down, the upper portion of the front frame is parallel to the left frame, the right frame and the lower portion of the front frame, the rear side of the upper portion of the front frame is facing the left side of the left frame and the right side of the right frame, the left frame and the right frame are sandwiched by the lower portion and the upper portion of the front frame.

In implantation, the present invention further comprises a first top rod, wherein a rear side of the first top rod has at least one second hoop. A left end and a right end of the first top rod are detachably connected to a top end of the left-rear rod and a top end of the right-rear rod respectively.

In implantation, the present invention further comprises a net, wherein the net is connected to an outer peripheral edge of the foldable basketball stand. An inclined net surface is formed between the front frame and the rear frame.

In implantation, the rear frame further comprises a lower second top rod parallel to the upper second top rod on the upper portion of the rear frame. A left end of the lower second top rod is connected to the second left rod. A right end of the lower second top rod is connected to the second right rod.

In implantation, the present invention further comprises a middle connecting rod and a supporting rod, wherein a left end and a right end of the middle connecting rod are detachably connected to a bottom end of the lower portion of the left-rear rod and a bottom end of the lower portion of the right-rear rod respectively. A bottom-front end and a top-rear end of the supporting rod are detachably connected to a middle portion of the middle connecting rod and a middle portion of the lower second top rod respectively.

For further understanding the characteristics and effects of the present invention, some preferred embodiments referred to drawings are in detail described as follows.

DETAILED DESCRIPTIONS OF PREFERRED EMBODIMENTS

Figure 1:
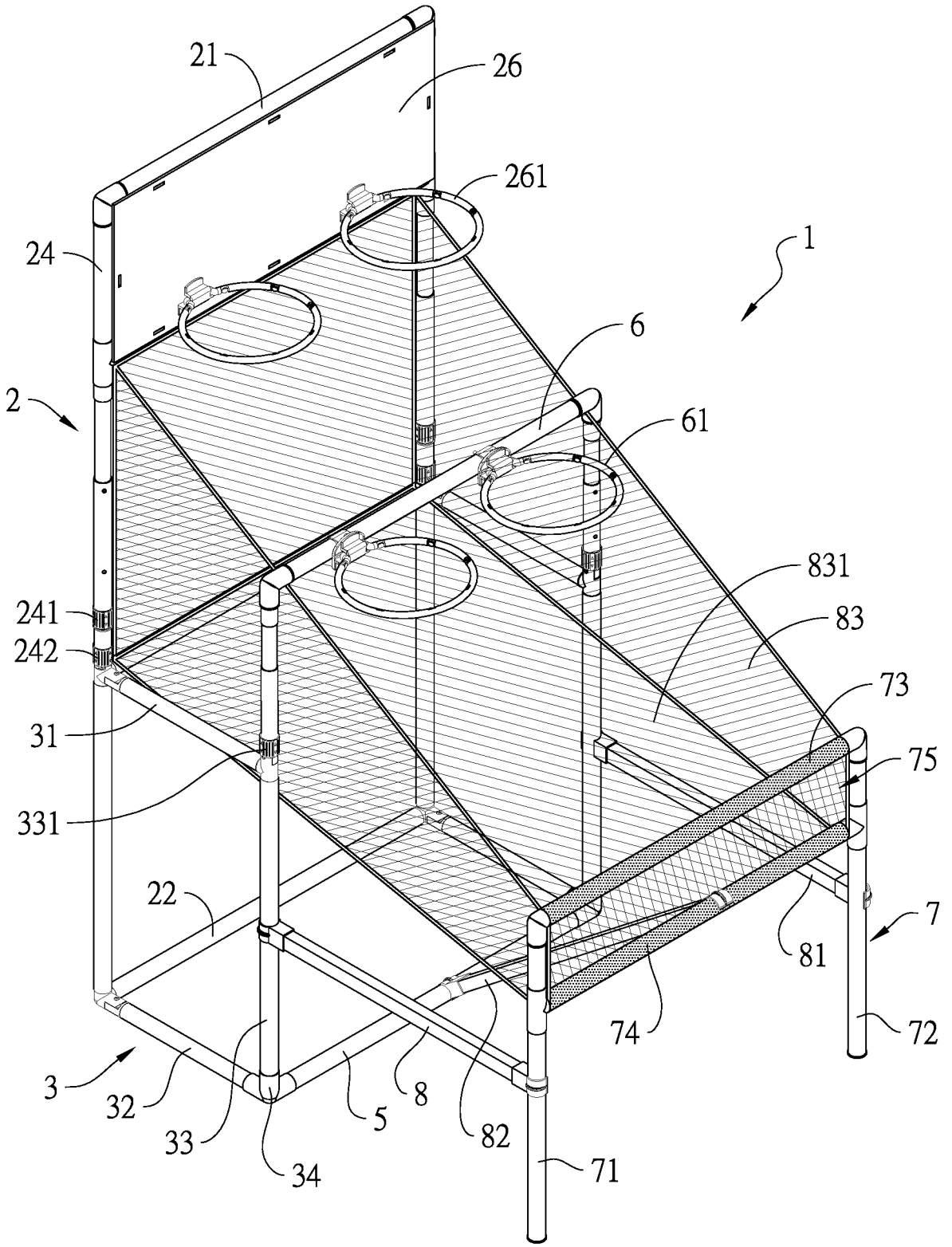
FIG. 1 is a perspective view of the first embodiment of the present invention provided with net.
Figure 2:
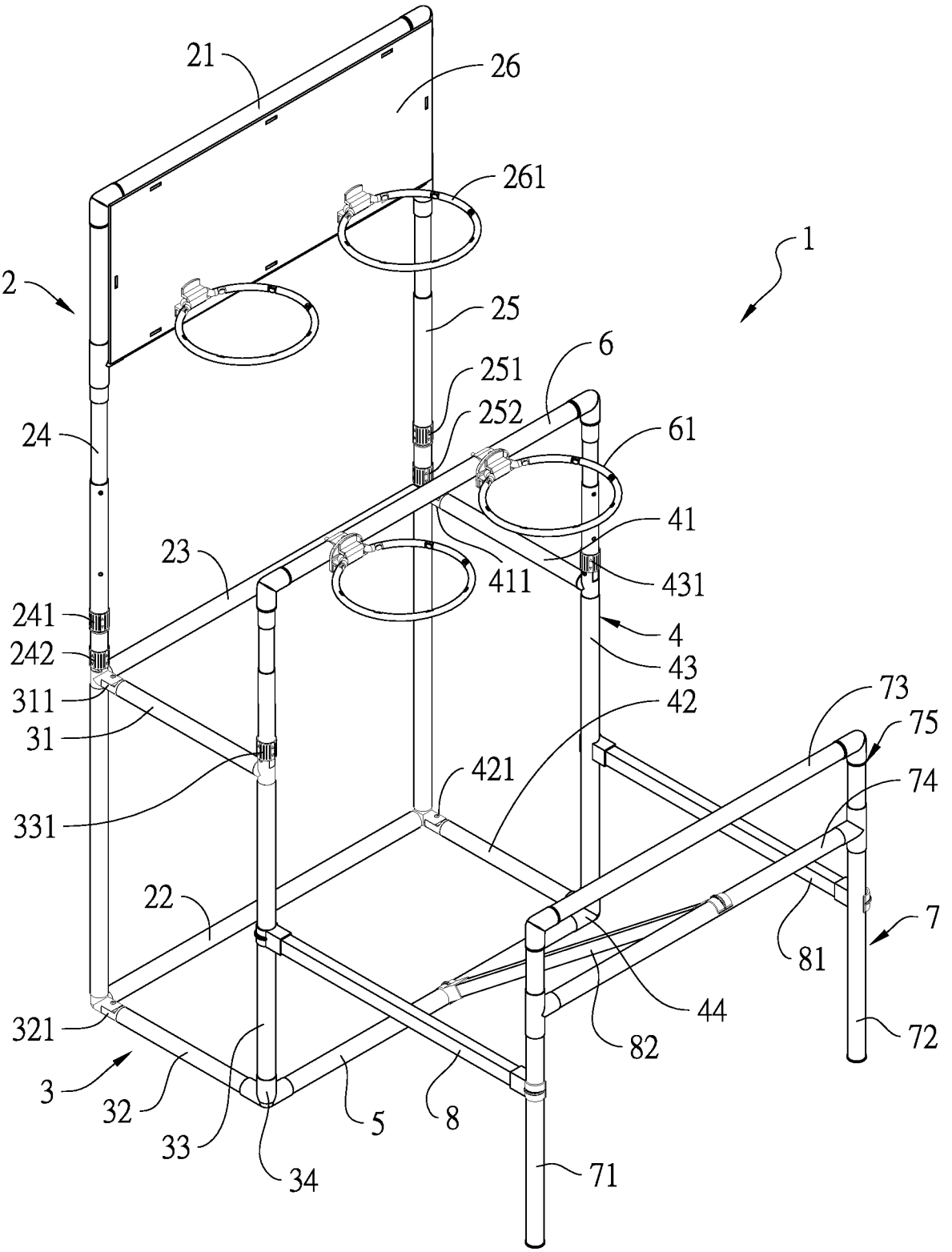
FIG. 2 is a perspective view of the first embodiment of the present invention.

Please refer to FIGS. 1 and 2 showing the first embodiment of a foldable basketball stand 1 of the present invention. The foldable basketball stand 1 mainly comprises a front frame 2, a left frame 3, a right frame 4, a middle connecting rod 5, a first top rod 6, a rear frame 7, a left connecting rod 8, a right connecting rod 81, a supporting rod 82, and a net 83. One end of the foldable basketball stand 1 having a backboard 26 is defined as a front end of the foldable basketball stand 1, while a position where a shooter stands distant from the backboard 26 is defined as a rear end of the foldable basketball stand 1. And a left end and a right end of the foldable basketball stand 1 are defined respectively, by the direction in which the shooter faces the backboard 26.

The front frame 2 is an upstanding quadrangular frame, which comprises a top rod 21, a bottom rod 22, a middle-cross rod 23, a first left rod 24, and a first right rod 25. The first left rod 24 has an upper portion, a middle portion, and a lower portion. A first left joint 241 and a second left joint 242 are disposed on the first left rod 24 between the upper portion and the middle portion of the first left rod 24 and between the middle portion and the lower portion of the first left rod 24 respectively. Similarly, the first right rod 25 has an upper portion, a middle portion, and a lower portion. A first right joint 251 and a second right joint 252 are disposed on the first right rod 25 between the upper portion and the middle portion of the first right rod 25 and between the middle portion and the lower portion of the first right rod 25 respectively. The first left joint 241 and the first right joint 251 are left-right symmetrically disposed; and the second left joint 242 and the second right joint 252 are left-right symmetrically disposed. Two ends of the top rod 21 are connected to a top end of the upper portion of the first left rod 24 and a top end of the upper portion of the first right rod 25 respectively. Two ends of the bottom rod 22 are connected to a bottom end of the lower portion of the first left rod 24 and a bottom end of the lower portion of the first right rod 25 respectively. One end of the middle-cross rod 23 is connected to a top end of the lower portion of the first left rod 24 below the second left joint 242; while the other end of the middle-cross rod 23 is connected to a top end of the lower portion of the first right rod 25 below the second right joint 252. An upper portion of the front frame 2 is between the upper portion of the first left rod 24 and the upper portion of the first right rod 25. A lower portion of the front frame 2 is between the lower portion of the first left rod 24 and the lower portion of the first right rod 25. A middle portion of the front frame 2 is between the upper portion of the front frame 2 and the lower portion of the front frame 2 (that is, between the middle portion of the first left rod 24 and the middle portion of the first right rod 25). The upper portion of the front frame 2 has a rear side. The middle portion of the front frame 2 has a rear side. The lower portion of the front frame 2 has a rear side. The upper portion of the front frame 2 is provided with the backboard 26. A rear surface of the backboard 26 has two first hoops 261 arranged horizontally at intervals. The upper portion of the first left rod 24 and the upper portion of the first right rod 25 are capable of being rotated synchronously relative to the first left joint 241 and the first right joint 251 respectively. The middle portion of the first left rod 24 and the middle portion of the first right rod 25 are capable of being rotated synchronously relative to the second left joint 242 and the second right joint 252 respectively. A first left pivoting element 311 is disposed on a rear side of the top end of the lower portion of the first left rod 24 below the second left joint 242. A second left pivoting element 321 is disposed on a rear side of the bottom end of the lower portion of the first left rod 24. A first right pivoting element 411 is disposed on a rear side of the top end of the lower portion of the first right rod 25 below the second right joint 252. A second right pivoting element 421 is disposed on a rear side of the bottom end of the lower portion of the first right rod 25.

The left frame 3 is an upstanding rectangular frame, which comprises a left-top rod 31, a left-bottom rod 32 and a left-rear rod 33. The left-rear rod 33 has an upper portion and a lower portion. A first rear joint 331 is disposed on the left-rear rod 33 between the upper portion and the lower portion of the left-rear rod 33, so that the upper portion of the left-rear rod 33 is capable of being rotated relative to the first rear joint 331. One end of the left-top rod 31 is connected to a top end of the lower portion of the left-rear rod 33. One end of the left-bottom rod 32 is connected to a bottom end of the lower portion of the left-rear rod 33 through a left T-junction 34. The other end of the left-top rod 31 is pivoted to the first left pivoting element 311; while the other end of the left-bottom rod 32 is pivoted to the second left pivoting element 321, so that the left frame 3 is capable of being horizontally rotated relative to the first left pivoting element 311 and the second left pivoting element 321 (that is, the left frame 3 is capable of being horizontally rotated relative to the first left rod 24). The left frame 3 has a left side and a right side.

The right frame 4 is an upstanding rectangular frame. The right frame 4 and the left frame 3 are arranged symmetrically at the right and the left sides of the front frame 2. The right frame 4 comprises a right-top rod 41, a right-bottom rod 42, and a right-rear rod 43. The right-rear rod 43 has an upper portion and a lower portion. A second rear joint 431 is disposed on the right-rear rod 43 between the upper portion and the lower portion of the right-rear rod 43, so that the upper portion of the right-rear rod 43 is capable of being rotated relative to the second rear joint 431. One end of the right-top rod 41 is connected to a top end of the lower portion of the right-rear rod 43. One end of the right-bottom rod 42 is connected to a bottom end of the lower portion of the right-rear rod 43 through a right T-junction 44. The other end of the right-top rod 41 is pivoted to the first right pivoting element 411; while the other end of the right-bottom rod 42 is pivoted to the second right pivoting element 421, so that the right frame 4 is capable of being horizontally rotated relative to the first right pivoting element 411 and the second right pivoting element 421 (that is, the right frame 4 is capable of being horizontally rotated relative to the first right rod 25). The right frame 4 has a left side and a right side.

A left end of the middle connecting rod 5 is connected to the bottom end of the lower portion of the left-rear rod 33 through the left T-junction 34. A right end of the middle connecting rod 5 is connected to the bottom end of the lower portion of the right-rear rod 43 through the right T-junction 44. A length of the middle connecting rod 5 is slightly longer than a distance between a port of the left T-junction 34 and a port of the right T-junction 44. By the left-right movement, the left end and the right end of the middle connecting rod 5 are detachably connected to the bottom end of the lower portion of the left-rear rod 33 and the bottom end of the lower portion of the right-rear rod 43 respectively. A rear side of the first top rod 6 has two second hoops 61 arranged horizontally at intervals. A left end of the first top rod 6 is connected to a top end of the upper portion of the left-rear rod 33 through an L-shaped left junction. A right end of the first top rod 6 is connected to a top end of the upper portion of the right-rear rod 43 through an L-shaped right junction. A length of the first top rod 6 is slightly longer than a distance between a port of the L-shaped left junction and a port of the L-shaped right junction. By the left-right movement, the left end and the right end of the first top rod 6 are detachably connected to the top end of the upper portion of the left-rear rod 33 and the top end of the upper portion of the right-rear rod 43 respectively.

The rear frame 7 is an upstanding rectangular frame, which comprises a second left rod 71, a second right rod 72, an upper second top rod 73, and a lower second top rod 74. A middle portion of the second left rod 71 is detachably connected to a rear end of the left connecting rod 8. A front end of the left connecting rod 8 is detachably connected to the lower portion of the left-rear rod 33 between the top end and the bottom end of the lower portion of the left-rear rod 33. A middle portion of the second right rod 72 is detachably connected to a rear end of the right connecting rod 81. A front end of the right connecting rod 81 is detachably connected to the lower portion of the right-rear rod 43 between the top end and the bottom end of the lower portion of the right-rear rod 43. The upper second top rod 73 and the lower second top rod 74 are parallel. A left end of the upper second top rod 73 is connected to a top end of the second left rod 71 through an elbow. A right end of the upper second top rod 73 is connected to a top end of the second right rod 72 through another elbow. A left end of the lower second top rod 74 is connected to the second left rod 71 through a T-shaped tube. A right end of the lower second top rod 74 is connected to the second right rod 72 through another T-shape tube. A bottom-front end and a top-rear end of the supporting rod 82 are detachably connected to a middle portion of the middle connecting rod 5 and a middle portion of the lower second top rod 74 respectively.

The net 83 is connected to an outer peripheral edge of the foldable basketball stand 1 to form a block below the backboard 26 of the front frame 2 and the left side and the right side of the foldable basketball stand 1 respectively, and to form an inclined net surface 831 between the middle-cross rod 23 of the front frame 2 and the lower second top rod 74 of the rear frame 7. After the basketball thrown by the shooter touches the hoop or the backboard 26, the basketball can roll rearward and downward. A stop portion 75 formed between the upper second top rod 73 and the lower second top rod 74 can stop the rolling of the basketball and store plurality of basketballs.

Figure 3:
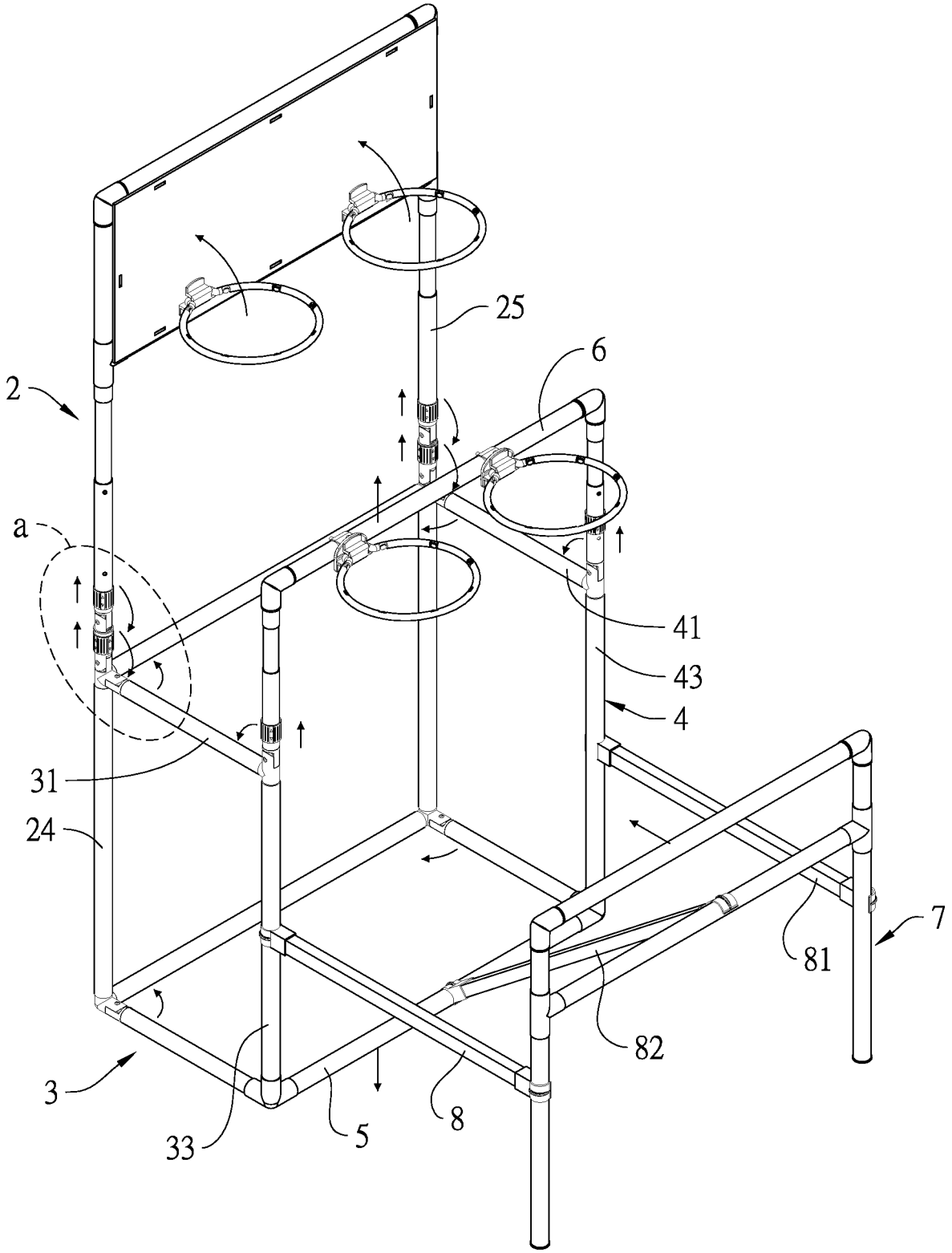
FIG. 3 is a schematic use state view of the first embodiment of the present invention in a to-be-folded state.
Figure 4:
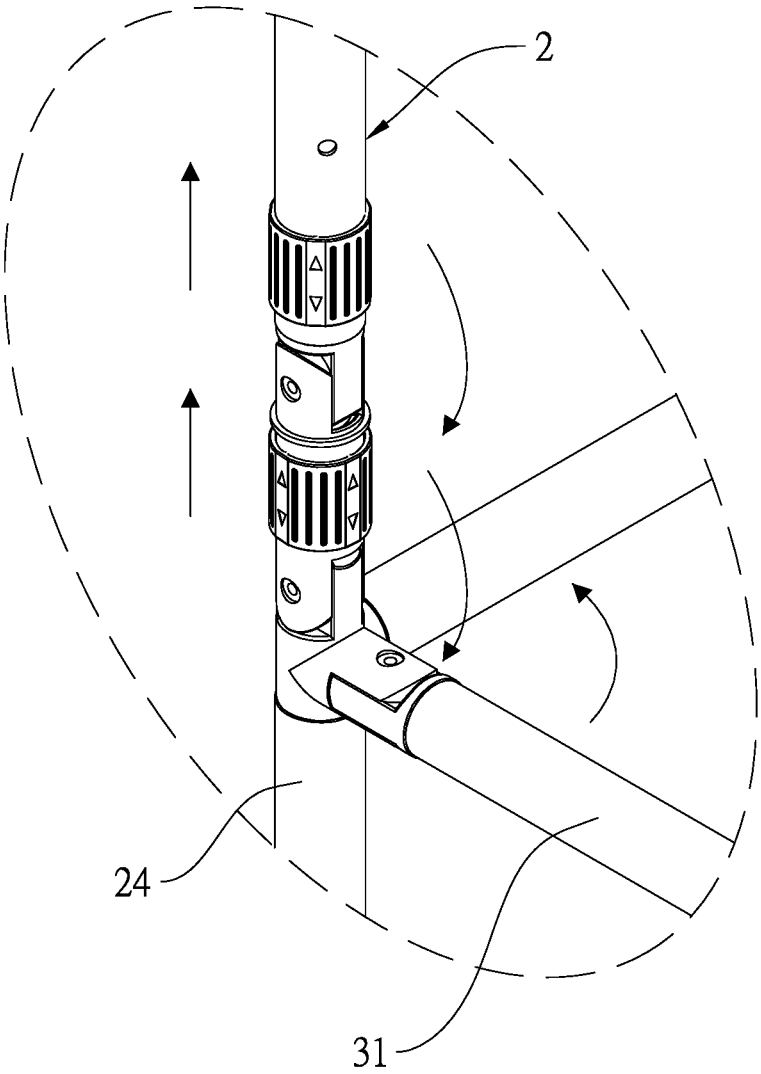
FIG. 4 is a partial enlargement view of portion a of FIG. 3.
Figure 5:
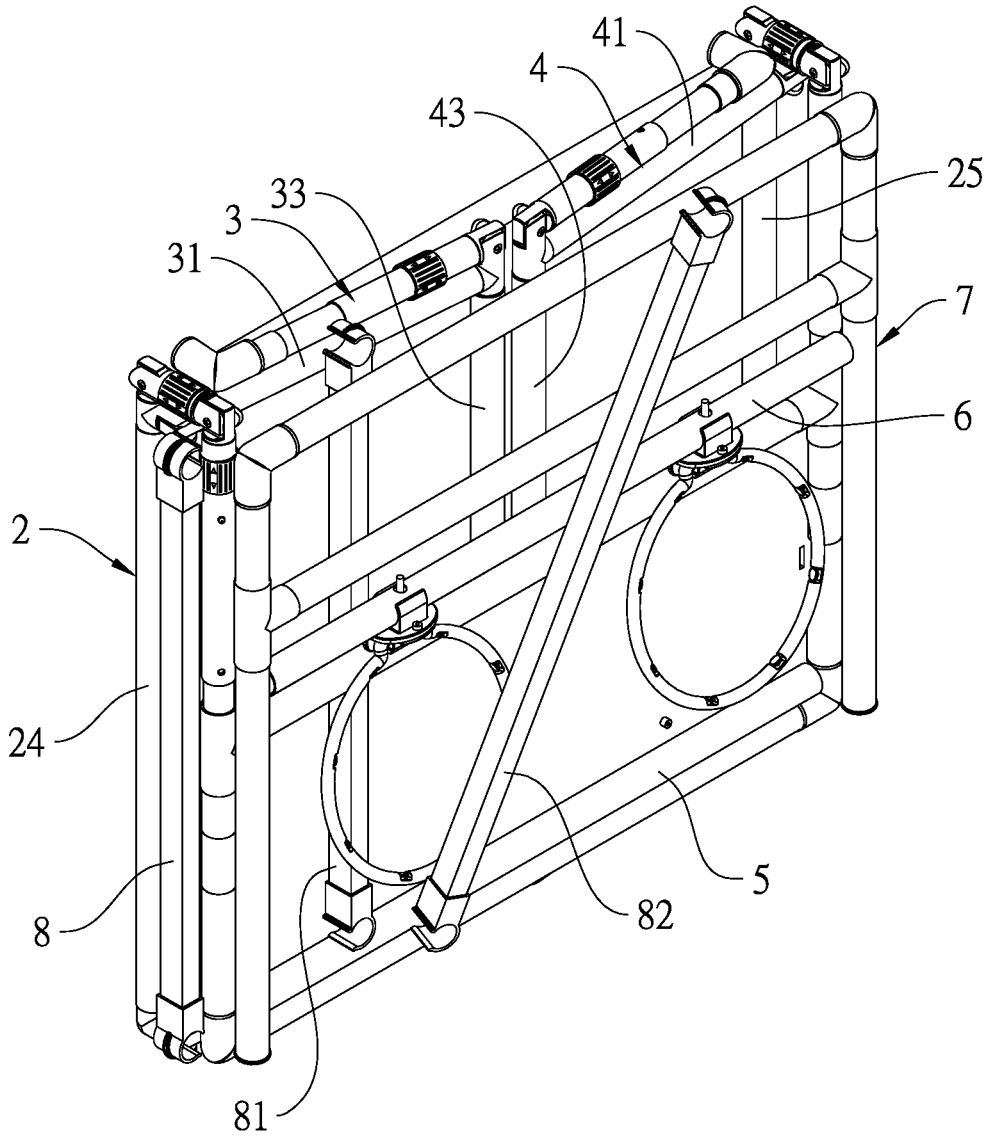
FIG. 5 is a perspective view of the first embodiment of the present invention in a folded state.

Therefore, as shown in FIGS. 3-5, the foldable basketball stand 1 of the present invention is capable of being transformed to a folded state through following steps of: disassembling the rear frame 7 by removing the left connecting rod 8, the right connecting rod 81, and the supporting rod 82; removing the middle connecting rod 5 and the first top rod 6; rotating the upper portion of the left-rear rod 33 relative to the first rear joint 331, so that the upper portion of the left-rear rod 33 is parallel to the left-top rod 31 and above the left-top rod 31; rotating the upper portion of the right-rear rod 43 relative to the second rear joint 431, so that the upper portion of the right-rear rod 43 is parallel to the right-top rod 41 and above the right-top rod 41; rotating the left frame 3 counterclockwise relative to the first left pivoting element 311 and the second left pivoting element 321 (that is, rotating the left frame 3 counterclockwise relative to the first left rod 24) and rotating the right frame 4 clockwise relative to the first right pivoting element 411 and the second right pivoting element 421 (that is, rotating the right frame 4 clockwise relative to the first right rod 25), so that the left-top rod 31 and the right-top rod 41 are parallel to the middle-cross rod 23, the left-bottom rod 32 and the right-bottom rod 42 are parallel to the bottom rod 22, the left frame 3 and the right frame 4 are parallel to the lower portion of the front frame 2, and the right side of the left frame 3 and the left side of the right frame 4 are facing the rear side of the lower portion of the front frame 2; synchronously rotating the upper portion of the first left rod 24 relative to the first left joint 241 and rotating the upper portion of the first right rod 25 relative to the first right joint 251, so that the upper portion of the first left rod 24 is perpendicular to the middle portion of the first left rod 24, the upper portion of the first right rod 25 is perpendicular to the middle portion of the first right rod 25, the upper portion of the front frame 2 is perpendicular to the middle portion of the front frame 2, the rear side of the upper portion of the front frame 2 is facing down; synchronously rotating the middle portion of the first left rod 24 relative to the second left joint 242 and rotating the middle portion of the first right rod 25 relative to the second right joint 252, so that the middle portion of the first left rod 24 is perpendicular to the lower portion of the first left rod 24, the middle portion of the first right rod 25 is perpendicular to the lower portion of the first right rod 25, the middle portion of the front frame 2 is perpendicular to the lower portion of the front frame 2, the rear side of the middle portion of the front frame 2 is facing down, the upper portion of the front frame 2 is parallel to the left frame 3, the right frame 4 and the lower portion of the front frame 2, the rear side of the upper portion of the front frame 2 is facing the left side of the left frame 3 and the right side of the right frame 4; so that a height of the front frame 2 can be shortened, and the left frame 3 and the right frame 4 are sandwiched by the lower portion and the upper portion of the front frame 2.

Figure 6:
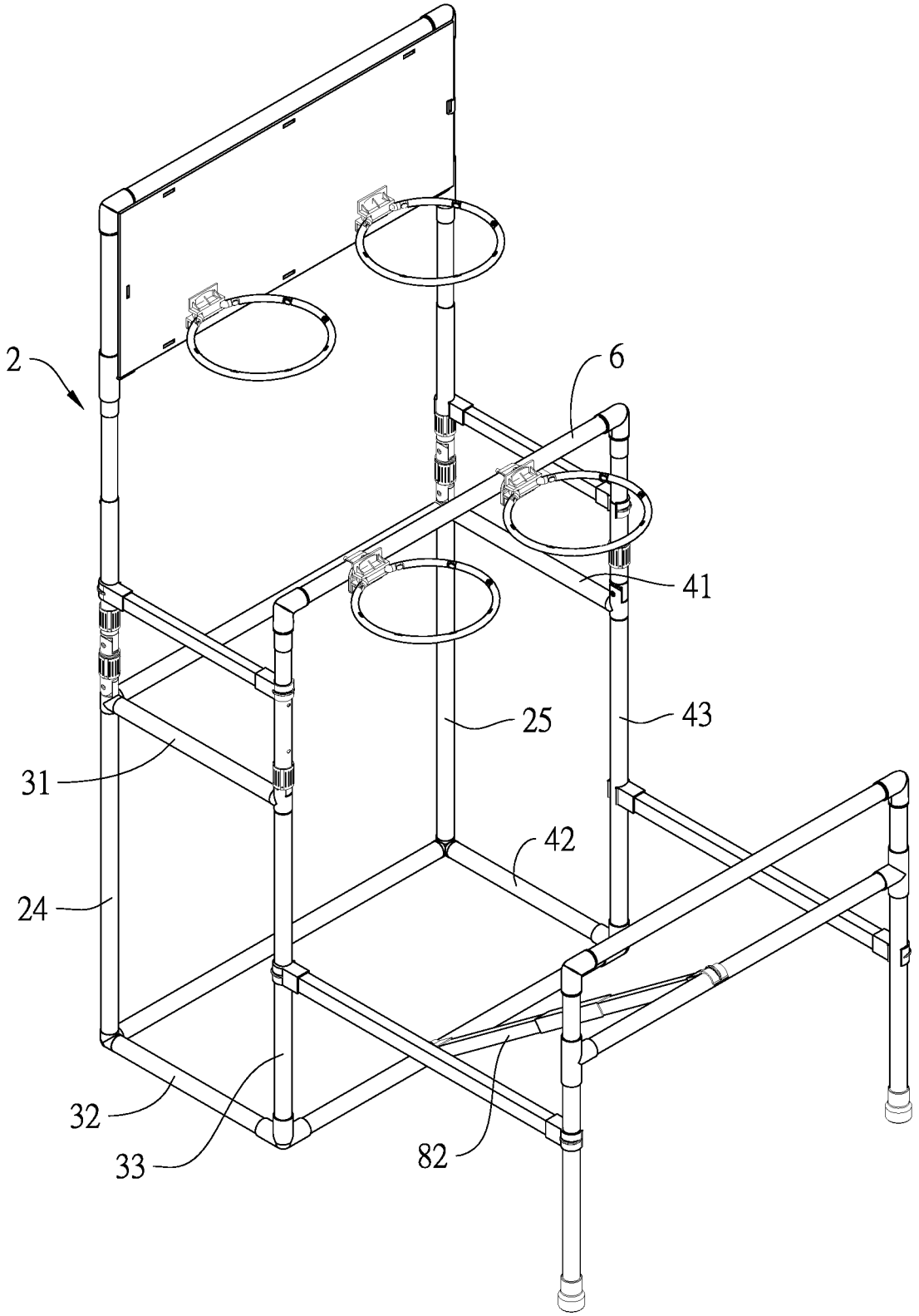
FIG. 6 is a perspective view of the second embodiment of the present invention.
Figure 7:
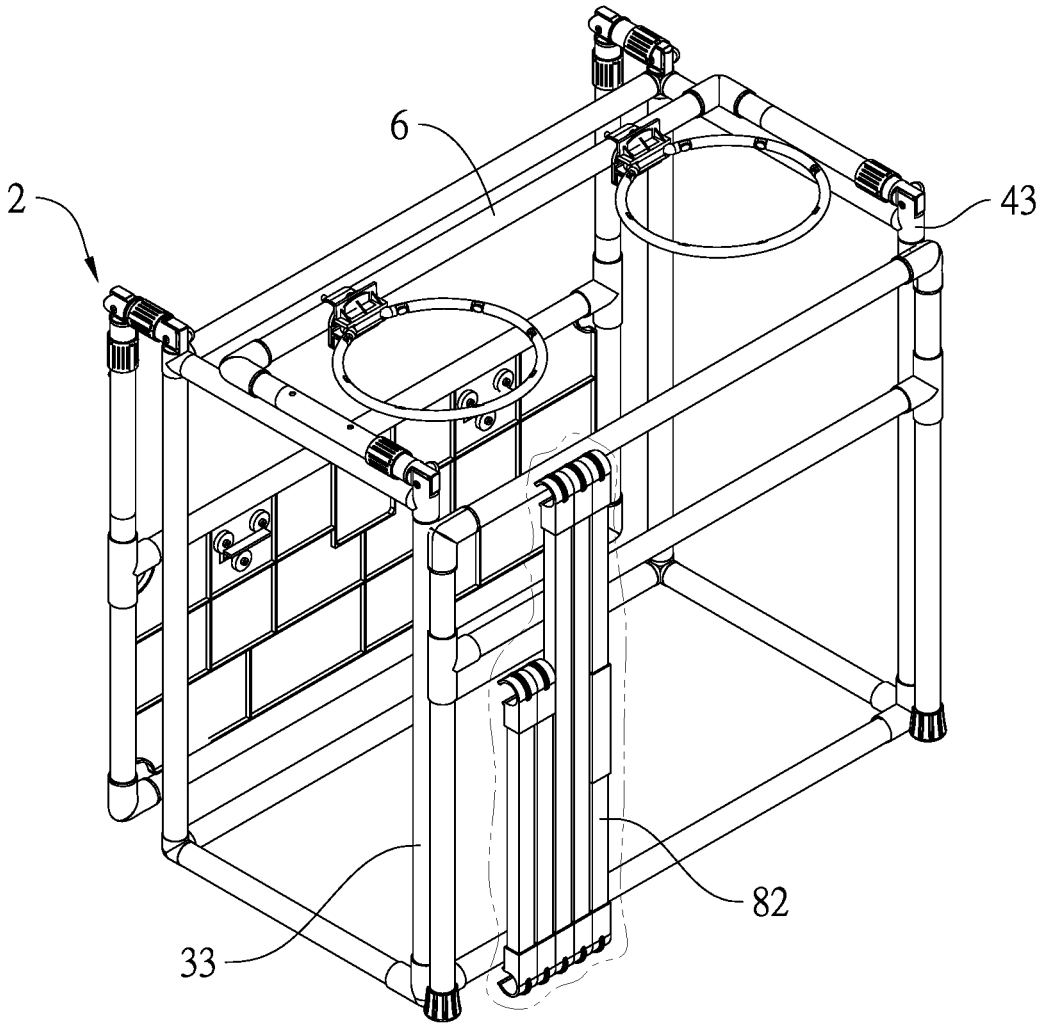
FIG. 7 is a schematic use state view of the second embodiment of the present invention in a folded state.

Please refer to FIGS. 6 and 7 showing the second embodiment of a foldable basketball stand 1 of the present invention. The main difference between current embodiment and the first embodiment is that: the other end of the left-top rod 31 is fixedly connected to the middle portion of the first left rod 24; the other end of the left-bottom rod 32 is fixedly connected to the bottom end of the first left rod 24; the other end of the right-top rod 41 is fixedly connected to the middle portion of the first right rod 25; the other end of the right-bottom rod 42 is fixedly connected to the bottom end of the first right rod 25; while the supporting rod 82 is a connecting rod capable of being extended and shortened. Therefore, through the front frame 2 being bent forward and downward sequentially, and the first top rod 6 being bent forward by the left-rear rod 33 and the right-rear rod 43, it can be folded faster than the first embodiment, and also can be expanded more quickly to save operating time; and the supporting rod 82 is capable of being extended and shortened, so that after shortened it can be bagged with other rods in parallel, which makes folding more efficient.

In summary, as disclosed in the above description and attached drawings, the present invention can indeed achieve the intended object. It can provide a folded basketball stand made by the combination of the supporting rods and connecting joints, which can achieve quick assembly and disassembly, and can effectively save storage space after disassembly and facilitate the carrying. It is novel and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A foldable basketball stand, wherein one end of said foldable basketball stand having a backboard is defined as a front end of said foldable basketball stand, while a position where a shooter stands distant from said backboard is defined as a rear end of said foldable basketball stand; and a left end and a right end of said foldable basketball stand are defined respectively by a direction in which said shooter faces said backboard, said foldable basketball stand comprises:

a front frame, which comprises a top rod, a first left rod, a bottom rod and a first right rod, wherein said first left rod has an upper portion, a middle portion and a lower portion, said first right rod has an upper portion, a middle portion and a lower portion, two ends of said top rod are connected to a top end of said upper portion of said first left rod and a top end of said upper portion of said first right rod respectively, two ends of said bottom rod are connected to a bottom end of said lower portion of said first left rod and a bottom end of said lower portion of said first right rod respectively, a first left joint and a second left joint are disposed on said first left rod between said upper portion and said middle portion of said first left rod and between said middle portion and said lower portion of said first left rod respectively, a first right joint and a second right joint are disposed on said first right rod between said upper portion and said middle portion of said first right rod and between said middle portion and said lower portion of said first right rod respectively, said first left joint and said first right joint are left-right symmetrically disposed, said second left joint and said second right joint are left-right symmetrically disposed, an upper portion of said front frame is between said upper portion of said first left rod and said upper portion of said first right rod, a lower portion of said front frame is between said lower portion of said first left rod and said lower portion of said first right rod, a middle portion of said front frame is between said middle portion of said first left rod and said middle portion of said first right rod, said upper portion of said front frame has a rear side, said middle portion of said front frame has a rear side, said lower portion of said front frame has a rear side, a first left pivoting element is disposed on a rear side of a top end of said lower portion of said first left rod, a second left pivoting element is disposed on a rear side of said bottom end of said lower portion of said first left rod, a first right pivoting element is disposed on a rear side of a top end of said lower portion of said first right rod, a second right pivoting element is disposed on a rear side of said bottom end of said lower portion of said first right rod, said backboard is disposed on said upper portion of said front frame, wherein a rear surface of said backboard has at least one first hoop;

a left frame, which comprises a left-top rod, a left-bottom rod, and a left-rear rod, wherein said left-rear rod has an upper portion and a lower portion, wherein one end of said left-top rod and one end of said left-bottom rod are connected to a top end and a bottom end of said lower portion of said left-rear rod respectively, wherein the other end of said left-top rod and the other end of said left-bottom rod are pivoted to said first left pivoting element and said second left pivoting element respectively, said left frame has a left side and a right side, wherein a first rear joint is disposed on said left-rear rod between said upper portion and said lower portion of said left-rear rod;

a right frame, which comprises a right-top rod, a right-bottom rod, and a right-rear rod, said right frame has an upper portion and a lower portion, wherein one end of said right-top rod and one end of said right-bottom rod are connected to a top end and a bottom end of said lower portion of said right-rear rod respectively, wherein the other end of said right-top rod and the other end of said right-bottom rod are pivoted to said first right pivoting element and said second right pivoting element respectively, said right frame has a left side and a right side, wherein a second rear joint is disposed on said right-rear rod between said upper portion and said lower portion of said right-rear rod; and a rear frame having an upper second top rod, a second left rod and a second right rod, wherein said rear frame has a stop portion on an upper portion of said rear frame, wherein two ends of said upper second top rod are connected to a top end of said second left rod and a top end of said second right rod respectively, a middle portion of said second left rod is detachably connected to a rear end of a left connecting rod, a front end of said left connecting rod is detachably connected to said lower portion of said left-rear rod between said top end and said bottom end of said lower portion of said left-rear rod, a middle portion of said second right rod is detachably connected to a rear end of a right connecting rod, a front end of said right connecting rod is detachably connected to said lower portion of said right-rear rod between said top end and said bottom end of said lower portion of said right-rear rod;

wherein said foldable basketball stand is capable of being transformed to a folded state by removing said left connecting rod and said right connecting rod; rotating said upper portion of said left-rear rod relative to said first rear joint, so that said upper portion of said left-rear rod is parallel to said left-top rod and above said left-top rod; rotating said upper portion of said right-rear rod relative to said second rear joint, so that said upper portion of said right-rear rod is parallel to said right-top rod and above said right-top rod; rotating said left frame counterclockwise relative to said first left pivoting element and said second left pivoting element and rotating said right frame clockwise relative to said first right pivoting element and said second right pivoting element, so that said left frame and said right frame are parallel to said lower portion of said front frame, and said right side of said left frame and said left side of said right frame are facing said rear side of said lower portion of said front frame; synchronously rotating said upper portion of said first left rod relative to said first left joint and rotating said upper portion of said first right rod relative to said first right joint, so that said upper portion of said front frame is perpendicular to said middle portion of said front frame; synchronously rotating said middle portion of said first left rod relative to said second left joint and rotating said middle portion of said first right rod relative to said second right joint, so that said middle portion of said front frame is perpendicular to said lower portion of said front frame, said rear side of said middle portion of said front frame is facing down, said upper portion of said front frame is parallel to said left frame, said right frame and said lower portion of said front frame, said rear side of said upper portion of said front frame is facing said left side of said left frame and said right side of said right frame, said left frame and said right frame are sandwiched by said lower portion and said upper portion of said front frame, wherein a height of said front frame is shorten after said foldable basketball stand is transformed to said folded state.

2. The foldable basketball stand according to claim 1, further comprising a first top rod, wherein a rear side of said first top rod has at least one second hoop, wherein before said foldable basketball stand is transformed to said folded state, a left end and a right end of said first top rod are detachably connected to a top end of said upper portion of said left-rear rod and a top end of said upper portion of said right-rear rod respectively, wherein when said foldable basketball stand is being transformed to said folded state, said first top rod has to be removed before said upper portion of said left-rear rod is rotated relative to said first rear joint and before said upper portion of said right-rear rod is rotated relative to said second rear joint.

3. The foldable basketball stand according to claim 2, further comprising a net, wherein said net is connected to an outer peripheral edge of said foldable basketball stand, and an inclined net surface is formed between said front frame and said rear frame.

4. The foldable basketball stand according to claim 1, wherein said rear frame further comprises a lower second top rod parallel to said upper second top rod on said upper portion of said rear frame, wherein a left end of said lower second top rod is connected to said second left rod, wherein a right end of said lower second top rod is connected to said second right rod.

5. The foldable basketball stand according to claim 4, further comprising a middle connecting rod and a supporting rod, wherein before said foldable basketball stand is transformed to said folded state, a left end and a right end of said middle connecting rod are detachably connected to a bottom end of said lower portion of said left-rear rod and a bottom end of said lower portion of said right-rear rod respectively, wherein a bottom-front end and a top-rear end of said supporting rod are detachably connected to a middle portion of said middle connecting rod and a middle portion of said lower second top rod respectively, wherein when said foldable basketball stand is being transformed to said folded state, said middle connecting rod and said supporting rod have to be removed before said left frame is rotated counterclockwise relative to said first left rod and before said right frame is rotated clockwise relative to said first right rod.

6. The foldable basketball stand according to claim 5, further comprising a first top rod, wherein a rear side of said first top rod has at least one second hoop, wherein before said foldable basketball stand is transformed to said folded state, a left end and a right end of said first top rod are detachably connected to a top end of said upper portion of said left-rear rod and a top end of said upper portion of said right-rear rod respectively, wherein when said foldable basketball stand is being transformed to said folded state, said first top rod has to be removed before said upper portion of said left-rear rod is rotated relative to said first rear joint and before said upper portion of said right-rear rod is rotated relative to said second rear joint.

7. The foldable basketball stand according to claim 1, further comprising a net, wherein said net is connected to an outer peripheral edge of said foldable basketball stand, and an inclined net surface is formed between said front frame and said rear frame.

* * * * *